US009588450B2

(12) United States Patent
Tsuda et al.

(10) Patent No.: US 9,588,450 B2
(45) Date of Patent: Mar. 7, 2017

(54) MAGNETIC TONER

(71) Applicant: CANON KABUSHIKI KAISHA, Tokyo (JP)

(72) Inventors: Shohei Tsuda, Suntou-gun (JP); Koji Nishikawa, Susono (JP); Katsuhisa Yamazaki, Numazu (JP); Yojiro Hotta, Mishima (JP); Kazuo Terauchi, Numazu (JP); Motohide Shiozawa, Mishima (JP); Takeshi Naka, Suntou-gun (JP); Takuya Mizuguchi, Suntou-gun (JP); Takayuki Itakura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/892,575

(22) PCT Filed: Jul. 30, 2014

(86) PCT No.: PCT/JP2014/070659

§ 371 (c)(1),
(2) Date: Nov. 19, 2015

(87) PCT Pub. No.: WO2015/016384

PCT Pub. Date: Feb. 5, 2015

(65) Prior Publication Data

US 2016/0091809 A1 Mar. 31, 2016

(30) Foreign Application Priority Data

Jul. 31, 2013 (JP) ..... 2013-158911

(51) Int. Cl.
*G03G 9/08* (2006.01)
*G03G 9/083* (2006.01)
(Continued)

(52) U.S. Cl.
CPC ..... *G03G 9/0839* (2013.01); *G03G 9/081* (2013.01); *G03G 9/083* (2013.01); *G03G 9/0819* (2013.01);
(Continued)

(58) Field of Classification Search
CPC ..... G03G 9/0839; G03G 9/09725
(Continued)

(56) References Cited

U.S. PATENT DOCUMENTS 6,326,114 B1 12/2001 Itakura et al.
6,495,303 B1 12/2002 Kanda et al.
(Continued)

FOREIGN PATENT DOCUMENTS

JP 1-81771 A 3/1992
JP 2002-318467 A 10/2002
(Continued)

OTHER PUBLICATIONS

U.S. Appl. No. 14/975,495, Koji Nishikawa, filed Dec. 18, 2015.
(Continued)

*Primary Examiner* — Mark A Chapman
(74) *Attorney, Agent, or Firm* — Fitzpatrick, Cella, Harper & Scinto

(57) ABSTRACT

Provided is a magnetic toner in which enhancement of initial transfer efficiency and transfer efficiency that is stable during a long-term use are achieved by simultaneously suppressing the friction force between the toner and a drum and the cohesion between toners, and further the degradation in chargeability and fluidity caused by the deterioration of the toner. The magnetic toner includes: a magnetic toner particle; a first external additive; and a second external additive. The first external additive includes an organic-inorganic composite fine particle, a plurality of convexes derived from an inorganic fine particle being present on a surface of the
(Continued)

organic-inorganic composite fine particle, and has a number-average particle diameter of 50 nm or more and 500 nm or less. The second external additive includes a silica fine particle and has a number-average particle diameter of 5 nm or more and 30 nm or less. A shear load calculated from a rotation torque is 0.50 kPa or more and 2.00 kPa or less when a disc-shaped disc is pressed against a surface of a magnetic toner powder layer, the magnetic toner powder layer being produced by applying a vertical load of 9.0 kPa to the magnetic toner, under a vertical load of 5.0 kPa, and the disc which is being pressed is rotated, and an absolute value $|\zeta(T)-\zeta(A1)|$ of a difference between a zeta potential $\zeta(T)$ of the magnetic toner particle dispersed in water and a zeta potential $\zeta(A1)$ of the first external additive dispersed in water is 50 mV or less.

4 Claims, 2 Drawing Sheets

(51) Int. Cl.
*G03G 9/087* (2006.01)
*G03G 9/097* (2006.01)

(52) U.S. Cl.
CPC ..... *G03G 9/0827* (2013.01); *G03G 9/0833* (2013.01); *G03G 9/08755* (2013.01); *G03G 9/09716* (2013.01); *G03G 9/09725* (2013.01)

(58) Field of Classification Search
USPC ..... 430/108.7
See application file for complete search history.

(56) References Cited

U.S. PATENT DOCUMENTS

| | | | |
|---|---|---|---|
| 6,528,222 | B2 | 3/2003 | Kohtaki et al. |
| 6,586,147 | B2 | 7/2003 | Iida et al. |
| 6,630,277 | B2 | 10/2003 | Naka et al. |
| 6,664,016 | B2 | 12/2003 | Kanbayashi et al. |
| 6,703,176 | B2 | 3/2004 | Naka et al. |
| 6,751,424 | B2 | 6/2004 | Itakura et al. |
| 6,808,852 | B2 | 10/2004 | Hotta et al. |
| 6,905,808 | B2 | 6/2005 | Itakura et al. |
| 6,929,894 | B2 | 8/2005 | Sugahara et al. |
| 7,115,349 | B2 | 10/2006 | Iida et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,244,539 | B2 | 7/2007 | Baba et al. |
| 7,273,686 | B2 | 9/2007 | Onuma et al. |
| 7,279,262 | B2 | 10/2007 | Fujikawa et al. |
| 7,288,348 | B2 | 10/2007 | Hayami et al. |
| 7,288,354 | B2 | 10/2007 | Moribe et al. |
| 7,297,455 | B2 | 11/2007 | Fujikawa et al. |
| 7,351,509 | B2 | 4/2008 | Moribe et al. |
| 7,396,626 | B2 | 7/2008 | Fujikawa et al. |
| 7,396,629 | B2 | 7/2008 | Baba et al. |
| 7,422,832 | B2 | 9/2008 | Ogawa et al. |
| 7,442,478 | B2 | 10/2008 | Itakura et al. |
| 7,455,947 | B2 | 11/2008 | Ida et al. |
| 7,537,877 | B2 | 5/2009 | Yoshiba et al. |
| 7,544,455 | B2 | 6/2009 | Yoshiba et al. |
| 7,582,401 | B2 | 9/2009 | Ogawa et al. |
| 7,611,813 | B2 | 11/2009 | Ida et al. |
| 7,629,100 | B2 | 12/2009 | Okamoto et al. |
| 7,638,251 | B2 | 12/2009 | Yamazaki et al. |
| 7,700,254 | B2 | 4/2010 | Moribe et al. |
| 7,740,998 | B2 | 6/2010 | Yamazaki et al. |
| 7,745,089 | B2 | 6/2010 | Okubo et al. |
| 7,803,508 | B2 | 9/2010 | Ishii et al. |
| 7,816,063 | B2 | 10/2010 | Hashimoto et al. |
| 7,855,042 | B2 | 12/2010 | Kobori et al. |
| 7,858,283 | B2 | 12/2010 | Ishigami et al. |
| 7,897,316 | B2 | 3/2011 | Yamazaki et al. |
| 7,906,262 | B2 | 3/2011 | Ishigami et al. |
| 7,927,775 | B2 | 4/2011 | Komatsu et al. |
| 7,939,233 | B2 | 5/2011 | Inoue et al. |
| 8,026,030 | B2 | 9/2011 | Moribe et al. |
| 8,057,977 | B2 | 11/2011 | Moribe et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,323,726 | B2 | 12/2012 | Naka et al. |
| 8,501,377 | B2 | 8/2013 | Takahashi et al. |
| 8,512,925 | B2 | 8/2013 | Moribe et al. |
| 8,927,188 | B2 | 1/2015 | Naka et al. |
| 8,986,914 | B2 | 3/2015 | Fujikawa et al. |
| 9,034,549 | B2 | 5/2015 | Shiotari et al. |
| 9,040,216 | B2 | 5/2015 | Fukudome et al. |
| 9,046,800 | B2 | 6/2015 | Hotta et al. |
| 9,097,998 | B2 | 8/2015 | Yamazaki et al. |
| 9,116,448 | B2 | 8/2015 | Terauchi et al. |
| 9,128,400 | B2 | 9/2015 | Takahashi et al. |
| 9,134,637 | B2 | 9/2015 | Hotta et al. |
| 9,141,012 | B2 | 9/2015 | Moribe et al. |
| 9,201,323 | B2 | 12/2015 | Nishikawa et al. |
| 9,250,548 | B2 | 2/2016 | Nomura et al. |
| 9,256,148 | B2 | 2/2016 | Fujikawa et al. |
| 9,261,804 | B2 | 2/2016 | Yamazaki et al. |
| 9,341,970 | B2 | 5/2016 | Yoshiba et al. |
| 2007/0202424 | A1 | 8/2007 | Ogawa et al. |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |
| 2011/0089085 | A1 | 4/2011 | Tamura et al. |
| 2012/0214097 | A1 | 8/2012 | Naka et al. |
| 2013/0252167 | A1 | 9/2013 | Moribe et al. |
| 2013/0309603 | A1 | 11/2013 | Takahashi et al. |
| 2014/0295341 | A1 | 10/2014 | Fomitchev et al. |
| 2015/0037719 | A1 | 2/2015 | Naka et al. |
| 2015/0125790 | A1 | 5/2015 | Hotta et al. |
| 2015/0220013 | A1 | 8/2015 | Nishikawa et al. |
| 2016/0041481 | A1 | 2/2016 | Nomura et al. |
| 2016/0041482 | A1 | 2/2016 | Terauchi et al. |
| 2016/0041483 | A1 | 2/2016 | Nishikawa et al. |
| 2016/0041484 | A1 | 2/2016 | Tsuda et al. |
| 2016/0070192 | A1 | 3/2016 | Terauchi et al. |
| 2016/0091813 | A1 | 3/2016 | Yoshiba et al. |
| 2016/0139521 | A1 | 5/2016 | Tsuda et al. |
| 2016/0139522 | A1 | 5/2016 | Yoshiba et al. |
| 2016/0154331 | A1 | 6/2016 | Tanaka et al. |
| 2016/0161874 | A1 | 6/2016 | Yamazaki et al. |

FOREIGN PATENT DOCUMENTS

| | | | |
|---|---|---|---|
| JP | 2003-233213 | A | 8/2003 |
| JP | 2005-202131 | A | 7/2005 |
| JP | 2007-279702 | A | 10/2007 |
| JP | 2008-292675 | A | 12/2008 |
| JP | 2010-79312 | A | 4/2010 |
| JP | 2013-92748 | A | 5/2013 |
| WO | 2013/063291 | A1 | 5/2013 |

OTHER PUBLICATIONS

International Preliminary Report on Patentability and Written Opinion of the International Searching Authority, International Application No. PCT/JP2014/070659, Mailing Date Feb. 11, 2016.

International Search Report and Written Opinion of the International Searching Authority, International Application No. PCT/JP2014/070659, Mailing Date Sep. 9, 2014.

MAGNETIC TONER

TECHNICAL FIELD

The present invention relates to a magnetic toner to be used in an electrophotographic method, an image forming method for visualizing an electrostatic image, and a toner jet method (hereinafter sometimes referred to simply as "magnetic toner").

BACKGROUND ART

Hitherto, a magnetic toner to be used for forming an image by a magnetic one-component jumping development method has been required to have high fluidity so as to achieve stable supply to a developing sleeve, image density, and image stabilization, and as an external additive for imparting the fluidity, an external additive having a small particle diameter has been frequently used. However, the external additive having a small particle diameter involves a problem in that when the magnetic toner is transferred onto a medium, a great amount of a transfer residual toner remains on a drum (electrophotographic photosensitive member), and hence the consumption amount of the magnetic toner increases in order to satisfy image density, with the result that printing cost per sheet becomes high.

Further, in recent years, there has been a demand for higher speed and longer life in copying machines, printers, and the like, and it is predicted that shear which is more than before is applied to the magnetic toner between the developing sleeve and a toner regulating blade. Therefore, when the external additive having a small particle diameter is used in the same way as before, it is predicted that the external additive having a small particle diameter adhering to the surface of the magnetic toner is buried, and the external additive does not serve as an external additive. As a result, the transfer property is deteriorated during long-term use, which may cause image quality defects, with the result that there is a concern that satisfactory image density may not be obtained, and the consumption amount of the magnetic toner may increase further compared to that of the initial stage.

In order to solve the above-mentioned problem, in recent years, there has been proposed a monodispersed spherical external additive having a large particle diameter replacing the external additive having a small particle diameter (for example, PTL 1). However, when a toner using the monodispersed spherical external additive is applied to the magnetic one-component jumping development method, although the toner consumption amount is suppressed by the improvement of initial transfer efficiency, there is a possibility that the transfer property is deteriorated during long-term use, which may cause image quality defects.

In order to solve the above-mentioned problem, there have been proposed various procedures such as a procedure for enhancing adhesion strength during an external addition step and a procedure for changing the shape of an external additive itself.

For example, PTL 2 discloses a method of fixing inorganic fine powder having a large particle diameter to the surface of a toner particle by applying strong shear in a gap between a rotation drive part in an external additive mixing tank and a casing. However, this procedure is not necessarily effective for a pulverized toner, and the inorganic fine powder is rolled to a recess of the toner particle due to the strong shear force in the gap between the rotation drive part and the casing, with the result that there is a possibility that the inorganic fine powder may not serve as an external additive sufficiently.

For example, PTL 3 provides an example in which non-spherical amorphous silica having a large particle diameter is externally added so as to suppress the above-mentioned burial and rolling. However, when this example is applied to the magnetic one-component jumping development method, sliding between the developing sleeve and the toner regulating blade is stronger than that between two-component developers, and the external additive may be separated or packing between toners may occur. As a result, the developing property and transfer property are degraded, and there is a possibility that problems such as a white streak and density unevenness may occur.

In addition, PTL 4 and PTL 5 disclose examples using an organic-inorganic composite particle, in which an inorganic particle adheres to the surface of an organic particle, as a spacer particle. However, considering the future high speed and long life, when the composite particle is externally added to a negatively chargeable magnetic toner particle, the chargeability under a high-temperature and high-humidity environment may be degraded when the composite particle is a positively chargeable particle (PTL 4). Further, even when the composite particle is a negatively chargeable particle, there still remains room for improvement in the case of assuming further increases in speed and life (PTL 5).

Considering the foregoing, there still remains room for improvement so as to satisfy both the initial transfer property and durable stability and the stability of image quality in the magnetic one-component jumping development method.

CITATION LIST

Patent Literature

PTL 1: Japanese Patent Application Laid-Open No. 2002-318467

PTL 2: Japanese Patent Application Laid-Open No. JP 2008-292675

PTL 3: Japanese Patent Application Laid-Open No. 2007-279702

PTL 4: Japanese Patent Application Laid-Open No. 2005-202131

PTL 5: Japanese Patent Application Laid-Open No. 2013-92748

SUMMARY OF INVENTION

Technical Problem

The present invention is directed to providing a magnetic toner in which the above-mentioned problems have been solved.

Specifically, the present invention is directed to providing a magnetic toner having both satisfactory initial transfer property and satisfactory durable stability in a magnetic one-component jumping development method.

Solution to Problem

According to one aspect of the present invention, there is provided a magnetic toner, including:

a magnetic toner particle including a binder resin and a magnetic material;

a first external additive; and a second external additive, in which:

the first external additive i) is an organic-inorganic composite fine particle, a plurality of convexes derived from an inorganic fine particle being present on a surface of the organic-inorganic composite fine particle, and ii) has a number-average particle diameter of 50 nm or more and 500 nm or less;

the second external additive i) is a silica fine particle, and ii) has a number-average particle diameter of 5 nm or more and 30 nm or less;

a shear load calculated from a rotation torque is 0.50 kPa or more and 2.00 kPa or less when a disc-shaped disc is pressed against a surface of a magnetic toner powder layer, the magnetic toner powder layer being produced by applying a vertical load of 9.0 kPa to the magnetic toner, under a vertical load of 5.0 kPa in a measurement container, and the disc which is being pressed is rotated by $\pi/36$ rad at ($\pi/10$ rad)/min; and an absolute value $|\zeta(T)-\zeta(A1)|$ of a difference between a zeta potential $\zeta(T)$ of the magnetic toner particle dispersed in water and a zeta potential $\zeta(A1)$ of the first external additive dispersed in water is 50 mV or less.

Advantageous Effects of Invention

According to one embodiment of the present invention, it is possible to impart excellent transfer property through long-term use while suppressing the contamination of a member by improving initial transfer efficiency, and suppressing the burial and separation of the external additives due to the degradation in durability.

Further features of the present invention will become apparent from the following description of exemplary embodiments with reference to the attached drawings.

DESCRIPTION OF EMBODIMENTS

Figure 1A:
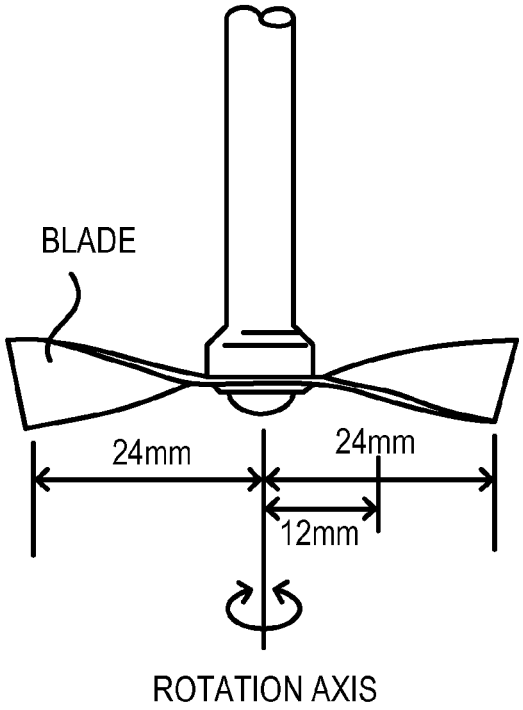
FIG. 1A is an explanatory diagram of a propeller-type blade to be used for measurement of a shear load value.

When a reduction in cost of printing is considered, it is necessary to further improve initial transfer property and reduce the consumption amount of a magnetic toner. Further, when high speed and long life are assumed, there is a demand for durable stability and stability of image quality higher than those of the related art. If the foregoing is achieved, the consumption amount of a magnetic toner can be kept constant at a small amount for a long period of time, which can substantially reduce the cost of printing. As a result of studies made by the inventors of the present invention, it has been found that the friction characteristics between a toner and a drum and the cohesion between toners are mutually related to the transfer property, and the deterioration of the toner is greatly related to the durable stability and the stability of image quality.

When an external additive having a small particle diameter as in the related art was used, a tendency was observed, in which a spacer effect between the toner and the drum is not sufficient, and the friction force between the toner and the drum increases. Thus, when the toner is transferred onto a medium, there arises a so-called "parting" problem in which the toner is transferred onto the medium from the middle of a toner layer without part of the toner being transferred onto the medium from the drum. Thus, there is a problem in that in order to satisfy image density, it is necessary to develop a larger amount of toner on the drum, which increases the consumption amount of the toner and increases printing cost per sheet.

As a procedure for achieving the reduction in friction force between the toner and the drum, for example, the use of a high spacer effect obtained by using monodispersed spherical silica having a large particle diameter is considered. However, according to this procedure, although the friction force between the toner and the drum is suppressed, the cohesion between toners increases, with the result that transfer efficiency cannot be enhanced.

Further, it has been found that the deterioration of a toner in the related-art magnetic one-component jumping phenomenon is mainly attributed to the burial of an external additive having a small particle diameter caused by the sliding between a developing sleeve and a toner regulating blade in a developing unit and the sliding between toners in agent circulation by a stirring blade in the developing unit. As a result, the friction force between the toner and the drum and the cohesion between toners increases to cause a charging defect and a decrease in fluidity, with the result that image density is degraded due to a transfer defect.

As a countermeasure against the foregoing problem, for example, there is given the addition of a great amount of an external additive having a small particle diameter typified by silica. This countermeasure is effective for prolonging the life with respect to durable stability in development and transfer but cannot prevent the burial of the external additive in the surface of a magnetic toner during long-term use, with result that the fluidity is degraded, and image quality is adversely affected. Further, it has been found that, even when silica is added in a great amount, silica is liable to adhere to silica, and the effect of reducing the cohesion between toners and the friction force between the toner and the drum reaches a plateau at a certain covering amount.

Further, in order to ensure stable fluidity, a procedure for using an external additive having a large particle diameter capable of serving as a spacer between magnetic toners together with an external additive having a small particle diameter is considered. However, when spherical silica produced by a wet sol-gel method is applied as the external additive having a large particle diameter, it is difficult to cause the external additive having a large diameter to adhere to the surface of the magnetic toner due to the spherical shape. As a result, the external additive is separated from the magnetic toner and cannot serve as a spacer sufficiently during long-term use. Accordingly, although a change in a surface state caused by the "burial" of the external additive having a large particle diameter externally added to the surface of the toner is suppressed, the external additive having a large particle diameter cannot serve as an external additive sufficiently due to the occurrence of a "rolling" phenomenon on the surface of the toner surface. As a result, the chargeability is degraded to cause an image defect, and further the separated external additive may contaminate a charging member in a developing unit. Alternatively, the external additive having a large particle diameter rolls on the surface of the magnetic toner, which may consequently cause the external additive having a small diameter used together to be buried to degrade the fluidity and degrade transfer efficiency.

Although odd-shape silica is used as the external additive which serves as a spacer sufficiently through durability for the purpose of changing the shape of the external additive, cracking and chipping of the external additive occur due to the sliding between the developing sleeve and the toner regulating blade and the like, with the result that the burial of the external additive in the surface of the toner cannot be prevented.

As described above, it has been actually difficult to simultaneously suppress the friction force between the toner and the drum and the cohesion between toners influencing the transfer property, and the degradation in transfer property caused by the deterioration of the toner due to, for example, the sliding between the developing sleeve and the toner regulating blade in a developing unit.

The inventors of the present invention have considered that, in order to simultaneously suppress the friction force between the toner and the drum and the cohesion between toners and to obtain a magnetic toner which has strong resistance to the deterioration of a toner, it is necessary to control the relationship between an external additive having a large particle diameter and a magnetic toner base material, as well as the design of the external additive having a large particle diameter. That is, the inventors of the present invention have considered that, for enhancing the transfer property, it is necessary to use an external additive having a large particle diameter having less contact points with a drum so as to reduce the friction force between the toner and the drum and to control the electric characteristics between a magnetic toner particle and the external additive having a large particle diameter so as to alleviate the cohesion between toners. Further, the inventors of the present invention have considered that the use of an external additive having a small particle diameter together with the external additive having a large particle diameter can control the uniformity of adhesion to the surface of the magnetic toner, stabilize transfer efficiency during long-term use, and reduce a toner consumption amount.

As a result of earnest studies made by the inventors of the present invention, it has been found that the following items need to be satisfied in order to suppress the friction force between the toner and the drum and the cohesion between toners, and further to suppress the degradation in chargeability and fluidity caused by the deterioration of the toner, that is, to stabilize the transfer property.

Specifically, it is necessary to use organic-inorganic composite fine particles each having a particular particle diameter as a first external additive to be externally added to a magnetic toner, and to control a shear load value applied to the surface of a consolidated magnetic toner powder layer and a potential difference $\zeta$ between the magnetic toner particle and the first external additive in a certain range.

The first external additive to be used in the present invention is organic-inorganic composite fine particles on the surface of each of which a plurality of convexes derived from inorganic fine particles is present. The organic-inorganic composite fine particles can comprise a resin particle and inorganic fine particles embedded to the resin particles so that the plurality of convexes derived from the inorganic particles is present.

In the case where the first external additive is simple resin particles, the friction force between the toner and the drum increases, and the transfer efficiency is degraded greatly. On the other hand, in the case where the first external additive is simply inorganic fine powder such as silica, it is difficult to satisfy both the friction force between the toner and the drum and the cohesion between toners, and hence the effect on the enhancement of transfer efficiency cannot be expected.

Further, as the first external additive having no convexes, inorganic fine particles completely embedded in resin particles are considered. When the inorganic fine particles are completely embedded in the resin particles, the resin particles are liable to roll on the surfaces of magnetic toner particles during an external addition step, resulting in difficulty in obtaining adhesion uniformity. As a result, contact points between the toner and the drum cannot be reduced effectively, and the friction force between the toner and the drum increases, which degrades transfer efficiency.

Further, the organic-inorganic composite fine particles to be used in the present invention have a feature in that the organic-inorganic composite fine particles have a number-average particle diameter, which is measured by scaling up the organic-inorganic composite fine particles by a magnification of 200,000 and observing the particles, of 50 nm or more and 500 nm or less.

When the number-average particle diameter is less than 50 nm, the external additive is liable to be buried due to the sliding between the developing sleeve and the toner regulating blade in the magnetic one-component jumping development method. As a result, the transfer efficiency after long-term use is degraded due to the degradation in chargeability and fluidity, and the toner consumption amount increases.

On the other hand, when the number-average particle diameter is larger than 500 nm, although the organic-inorganic composite fine particles serve as a spacer, they may move to recesses of the magnetic toner and are separated from the surface of the magnetic toner due to the long-term use, with the result that a charging member is contaminated and a white streak and density unevenness are observed in a solid black image. Further, the specific surface area of the external additive becomes small, and the external additive does not impart effective charging any more, which degrades developing property.

Further, the present invention has a feature in that silica fine particles having a number-average particle diameter of 5 nm or more and 30 nm or less as a second external additive. According to the results of studies made by the inventors of the present invention, when silica having a small particle diameter is used as the second external additive, silica enters minute recesses of the surface of a magnetic toner particle conveniently, and the surface of the magnetic toner particle is smoothened, with the result that the organic-inorganic composite fine particles serving as the first external additive uniformly adhere to the surface of the magnetic toner particle. This effect is continuously obtained even during the long-term use and enables the largest possible stabilization of transfer property to be obtained.

When the number-average particle diameter is less than 5 nm, silica having a small particle diameter coheres to each other and becomes unlikely to enter minute recesses of the surface of the magnetic toner particle, which degrades uniform adhesion of the first external additive.

On the other hand, when the number-average particle diameter is more than 30 nm, the surface area of a particle becomes small, and excellent sliding property which is a feature of silica having a small particle diameter is unlikely to be expressed, which influences the cohesion between toners. Alternatively, the silica having a small particle diameter becomes unlikely to enter minute recesses of the magnetic toner particle, which degrades the uniform adhesion of the first external additive.

Further, the present invention has a feature in that a shear load calculated from a rotation torque is 0.50 kPa or more and 2.00 kPa or less when a disc-shaped disc is pressed against the surface of a magnetic toner powder layer, the magnetic toner powder layer being produced by applying a vertical load of 9.0 kPa to the magnetic toner, under a vertical load of 5.0 kPa in a measurement container, and the disc which is being pressed is rotated by $\pi/36$ rad at ($\pi/10$ rad)/min.

On the other hand, when the shear load is more than 2.00 kPa, the friction force between the toner and the drum increases, and when the toner is transferred onto a medium, the "parting" occurs in which the toner is transferred onto the medium from the middle of a toner layer without part of the toner being transferred from the drum or an intermediate transfer member.

Further, the present invention has a feature in that the absolute value $|\zeta(T)-\zeta(A1)|$ of a difference between a zeta potential $\zeta(T)$ of the magnetic toner particles dispersed in water and a zeta potential $\zeta(A1)$ of the first external additive dispersed in water is 50 mV or less.

The zeta potential represents a surface charge density of the magnetic toner particles and the first external additive. Thus, the use of magnetic toner particles and a first external additive having an absolute value of the zeta potential difference of 50 mV or less means the use of an external additive having a surface charge density substantially equivalent to that of the surface of toner particles. In general, it is known that, in the case of adding an external additive to toner particles, intermolecular force such as van der Waals force, electrostatic attraction, liquid cross-linking force, and the like may occur. By equivalently controlling the charge densities of the respective surfaces of the toner particles and the first external additive on which such attraction is acting, repulsion force can be generated in a direction for alleviating the attraction acting on the toner particles and the external additive, and hence the cohesion between toners can be reduced.

When the absolute value of the zeta potential difference is more than 50 mV, electrostatic attraction greatly acts between the magnetic toner particles and the first external additive. Therefore, even when the friction force between the toner and the drum decreases, the following phenomenon is considered to occur: the cohesion between toners increases in a transfer nip part, and the toner is unlikely onto be transferred to a medium.

Accordingly, when the above-mentioned features are all satisfied, a magnetic toner is obtained in which the friction force between the toner and the drum and the cohesion between toners, and further the degradation in transfer efficiency occurring due to the deterioration of the toner can be suppressed simultaneously.

The organic-inorganic composite fine particles serving as the first external additive to be used in the present invention can be produced, for example, according to the description of Examples of International Publication No. WO 2013/063291.

The number-average particle diameter and shape of the organic-inorganic composite fine particles can be adjusted by changing the particle diameter of inorganic fine particles to be used in the organic-inorganic composite fine particles and the amount ratio between the inorganic fine particles and a resin.

It is preferred that in the organic-inorganic composite fine particles, the inorganic fine particles be partially embedded from the viewpoint that the adhesion strength to the surfaces of magnetic toner particles can be controlled easily. Further, it is more preferred that the surface existence ratio of the inorganic fine particles forming the organic-inorganic composite fine particles be 20% or more and 70% or less.

Further, the amount of the organic-inorganic composite fine particles serving as the first external additive is preferably 0.5 part by mass or more and 3.5 parts by mass or less, more preferably 0.8 part by mass or more and 2.0 parts by mass or less with respect to 100 parts by mass of the magnetic toner particles.

Further, in the toner of the present invention, it is preferred that the silica fine particles serving as the second external additive be hydrophobized, and it is particularly preferred that the silica fine particles be hydrophobized so that the hydrophobization degree measured by a methanol titration test be 40% or more, more preferably 50% or more.

As a method for the hydrophobization, there is given a method involving treating the silica fine particles with an organic silicon compound, silicone oil, a long-chain fatty acid, or the like.

Examples of the organic silicon compound include hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. One kind of those compounds may be used alone, or two or more kinds thereof may be used as a mixture.

Examples of the silicone oil include dimethyl silicone oil, methylphenyl silicone oil, α-methylstyrene-modified silicone oil, chlorophenyl silicone oil, and fluorine-modified silicone oil.

From the viewpoint of satisfying both the initial fluidity and the stabilization of chargeability through the long-term use, it is preferred that the total coverage rate of the first external additive and the second external additive on the surfaces of the magnetic toner be 40% or more and 85% or less. Further, it is more preferred that the ratio of the first external additive with respect to the total amount of the first and second external additives be 40 mass % or more and 70 mass % or less. By controlling the ratio in this range, the adhesion of small silica to minute recesses becomes more effective, that is, small silica is unlikely to cohere to each other, with the result that the uniform adhesion of the organic-inorganic composite fine particles is further enhanced.

Other external additives may be added to the toner of the present invention as necessary.

Examples of the external additives include resin fine particles and inorganic fine particles serving as an auxiliary charging agent, a conductivity imparting agent, a fluidity imparting agent, a caking inhibitor, a release agent for heat roller fixing, a lubricant, or an abrasive.

Examples of the lubricant include polyethylene fluoride powder, zinc stearate powder, and polyvinylidene fluoride powder. Of those, polyvinylidene fluoride powder is preferred.

Examples of the abrasive include cerium oxide powder, silicon carbide powder, and strontium titanate powder.

[Binder Resin]

As a binder resin to be used in the present invention, there are given a polyester-based resin, a vinyl-based resin, an epoxy resin, and a polyurethane resin.

[Magnetic Material]

In the present invention, as a magnetic material in the magnetic toner, there are given: iron oxides such as magnetite, hematite, and ferrite; and metals such as iron, cobalt, and nickel, and alloys and mixtures of these metals with metals such as aluminum, cobalt, copper, lead, magnesium, tin, zinc, antimony, bismuth, calcium, manganese, titanium, tungsten, and vanadium.

Such magnetic material has an average particle diameter of preferably 2 μm or less, more preferably 0.05 μm or more and 0.5 μm or less. The magnetic material is incorporated into the toner in an amount of preferably 40 parts by mass or more and 95 parts by mass or less with respect to 100 parts by mass of the binder resin component.

[Wax]

The magnetic toner of the present invention may also contain a wax.

Examples of the wax to be used in the present invention include the following: aliphatic hydrocarbon-based waxes such as low-molecular-weight polyethylene, low-molecular-weight polypropylene, a polyolefin copolymer, a polyolefin wax, a microcrystalline wax, a paraffin wax, and a Fischer-Tropsch wax; oxides of aliphatic hydrocarbon-based waxes such as a polyethylene oxide wax; or block copolymers of the waxes; plant-based waxes such as a candelila wax, a carnauba wax, a haze wax, and a jojoba wax; animal-based waxes such as a bees wax, lanolin, and a spermaceti wax; mineral-based waxes such as ozokerite, ceresin, and petrolatum; waxes containing fatty acid esters as main components such as a montanic acid ester wax and a castor wax; and partially or wholly deacidified fatty acid esters such as a deacidified carnauba wax. The examples further include: saturated linear fatty acids such as palmitic acid, stearic acid, montanic acid, and a long-chain alkylcarboxylic acid having an additionally long alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and an alkyl alcohol having an additionally long alkyl group; polyhydric alcohols such as sorbitol; fatty amides such as linoleic amide, oleic amide, and lauric amide; saturated fatty bis amides such as methylene bis stearamide, ethylene bis capramide, ethylene bis lauramide, and hexamethylene bis stearamide; unsaturated fatty acid amides such as ethylene bis oleamide, hexamethylene bis oleamide, N,N'-dioleyl adipamide, and N,N'-dioleyl sebacamide; aromatic bis amides such as m-xylene bis stearamide and N,N'-distearyl isophthalamide; aliphatic metal salts (which are generally referred to as metallic soaps) such as calcium stearate, calcium laurate, zinc stearate, and magnesium stearate; waxes obtained by grafting aliphatic hydrocarbon-based waxes with vinyl-based monomers such as styrene and acrylic acid; partially esterified products of fatty acids and polyhydric alcohols such as behenic monoglyceride; and methyl ester compounds each having a hydroxyl group obtained by the hydrogenation of vegetable oil.

In addition, the waxes whose molecular weight distribution is sharpened by a press sweating method, a solvent method, a recrystallization method, a vacuum distillation method, a supercritical gas extraction method, or a melt crystallization method, or waxes from which a low-molecular-weight solid fatty acid, a low-molecular-weight solid alcohol, a low-molecular-weight solid compound, or other impurities are removed are also preferably used.

Specific examples of the waxes that may be used as release agents include: Biscol (trademark) 330-P, 550-P, 660-P, and TS-200 (Sanyo Chemical Industries, Ltd.); Hiwax 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (NIPPON SEIRO CO., LTD.); Unilin (trademark) 350, 425, 550, and 700 and Unisid (trademark) 350, 425, 550, and 700 (TOYO-PETROLITE); and a haze wax, a beeswax, a rice wax, a candelilla wax, and a carnauba wax (available from CERARICA NODA Co., Ltd.).

[Charge-Controlling Agent]

In the magnetic toner to be used in the present invention, it is preferred to blend a charge-controlling agent with the magnetic toner particles (internal addition) or to mix the charge-controlling agent with the magnetic toner particles (external addition) so as to control a charge quantity and a charge quantity distribution of the magnetic toner particles.

As a negative charge-controlling agent for controlling the toner to negative chargeability, there are given an organic metal complex and a chelate compound. Examples of the organic metal complex include a mono azo metal complex, an acetylacetone metal complex, an aromatic hydroxycarboxylic acid metal complex, and an aromatic dicarboxylic acid metal complex.

Further, examples of the negative charge-controlling agent include: aromatic hydroxycarboxylic acid, aromatic monocarboxylic acid, and aromatic polycarboxylic acid, and metal salts thereof; and anhydrides of aromatic hydroxycarboxylic acid, aromatic monocarboxylic acid, and aromatic polycarboxylic acid.

The examples further include ester compounds of aromatic hydroxycarboxylic acid, aromatic monocarboxylic acid, and aromatic polycarboxylic acid, and a phenol derivative such as bisphenol.

Preferred examples of the negative charge-controlling agent for negative charging include Spilon Black TRH, T-77, T-95 (manufactured by Hodogaya Chemical Co., Ltd.), and BONTRON (trademark) S-34, S-44, S-54, E-84, E-88, E-89 (manufactured by Orient Chemical Industries Co., Ltd.).

Those charge-controlling agents can be used alone or in combination of two or more kinds. A charge-controlling resin can also be used and can be used together with the above-mentioned charge-controlling agents.

It is preferred that the above-mentioned charge-controlling agents be used in a fine particle shape. In the case of internally adding any such charge-controlling agent to the magnetic toner particles, it is preferred that the charge-controlling agent be added to the magnetic toner particles in an amount of 0.1 part by mass or more and 20.0 parts by mass or less with respect to 100.0 parts by mass of the binder resin.

The magnetic toner particles to be used in the present invention may be produced by any method such as a pulverization method or a polymerization method. From the viewpoint of controlling a shape, it is preferred that the magnetic toner particles be produced by a pulverization method.

Further, it is more preferred to use a method involving: sufficiently mixing the toner constituent materials as described above with a ball mill or another mixer; thoroughly kneading the mixture with a thermal kneader such as a heat roll, a kneader, or an extruder; solidifying the mixture by cooling; roughly pulverizing the resultant; subjecting the resultant to fine pulverization and classification; and modifying the surfaces of magnetic toner particles through use of a surface modifying device.

Examples of the mixer include: Henschel mixer (manufactured by Mitsui Mining Co., Ltd.); Super Mixer (manufactured by KAWATA MFG Co., Ltd.); Ribocone (manufactured by OKAWARA CORPORATION); Nauta Mixer, Turburizer, and Cyclomix (manufactured by Hosokawa Micron); Spiral Pin Mixer (manufactured by Pacific Machinery & Engineering Co., Ltd.); and Loedige Mixer (manufactured by MATSUBO Corporation).

Examples of the pulverizer include: Counter Jet Mill, Micron Jet, and Inomizer (manufactured by Hosokawa Micron); IDS-type Mill and PJM Jet Mill (manufactured by Nippon Pneumatic MFG Co., Ltd.); Cross Jet Mill (manufactured by Kurimoto Tekkosho KK); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd.); Turbo Mill (manufactured by Turbo Kogyo Co., Ltd.); and Super Rotor (manufactured by Nisshin Engineering Inc.).

Examples of the classifier include: Classiel, Micron Classifier, and Spedic Classifier (manufactured by Seishin Enterprise Co., Ltd.); Turbo Classifier (manufactured by Nisshin Engineering Inc.); Micron Separator, Turboprex (ATP), and TSP Separator (manufactured by Hosokawa Micron); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.).

Examples of the surface modifying device include Faculty (manufactured by Hosokawa Micron), Mechanofusion (manufactured by Hosokawa Micron), Nobilta (manufactured by Hosokawa Micron), Hybridizer (manufactured by NARA MACHINERY CO., LTD.), Inomizer (manufactured by Hosokawa Micron), Theta Composer (manufactured by TOKUJU CORPORATION), and MECHANOMILL (manufactured by OKADA SEIKO CO., LTD.).

The average surface roughness of the magnetic toner particles can be controlled mainly by controlling the inlet temperature and outlet temperature of cold air introduced into the surface modifying device.

The average surface roughness of the particle surfaces of the magnetic toner particles of the present invention is preferably 2.0 nm or more and 25.0 nm or less, more preferably 10.0 nm or more and 25.0 nm or less. The average surface roughness of the magnetic toner particles represents the smoothness of the surface of each magnetic toner particle. By controlling the surface state of the magnetic toner particles, the second external additive effectively adheres to minute recesses, and the adhesion strength of the first external additive and the uniformity of an externally added state can both be satisfied more easily.

As a sifter for sieving coarse particles and the like, there are given: Ultra Sonic (manufactured by Koei Sangyo Co., Ltd.); Rezona Sieve and Gyro Sifter (manufactured by Tokuju Corporation); Vibrasonic System (manufactured by Dalton Co., Ltd.); Sonicreen (manufactured by Shinto Kogyo K.K.); Turbo Screener (manufactured by Turbo Kogyo Co., Ltd.); Microsifter (manufactured by Makino mfg. co., Ltd.); and circular vibrating sieves.

The weight average particle diameter (D4) of the magnetic toner particles of the present invention is preferably 2.5 μm or more and 10.0 μm or less, more preferably 5.0 μm or more and 9.0 μm or less, still more preferably 6.0 μm or more and 8.0 μm or less because the magnetic toner particles having the above-mentioned average particle diameter (D4) exhibit sufficient effects.

Further, it is preferred that the magnetic toner particles to be used in the present invention have an average circularity of 0.930 or more and 0.960 or less from the viewpoint of satisfying both the enhancement of transfer efficiency and the separation of the external additives from the surface of the magnetic toner.

Further, the desired external additives as described above are sufficiently mixed with a mixer such as a Henschel mixer to produce the magnetic toner according to the present invention.

Methods of measuring physical properties of the magnetic toner of the present invention are as described below. Examples described later are also based on these methods.

<Measurement Method of Shape Factor SF-2 of Organic-Inorganic Composite Fine Particles>

The shape factor SF-2 of organic-inorganic composite fine particles was calculated as follows, based on the observation of a toner externally added with the external additives with a scanning electron microscope (SEM) "S-4800" (trade name, made by Hitachi, Ltd.). In a visual field under a magnifying power of up to 200,000, a organic-inorganic composite fine particle is observed to calculate the boundary length and the area for 100 pieces of primary particles with an image processing software "Image-Pro Plus 5.1J" (made by Media Cybernetics, Inc.). Herein, the observation magnification is appropriately adjusted depending on the size of the organic-inorganic composite fine particle. The shape factors SF-2 calculated from the following formula are averaged to determine the shape factor SF-2 of the organic-inorganic composite fine particles.

$$\text{SF-2}=(\text{boundary length of particle})^2/(\text{area of particle})\times 100/4\pi$$

<Method of Measuring Number-Average Particle Diameter of External Additive>

The number-average particle diameter of an external additive is measured through use of a scanning electron microscope "S-4800" (trade name; manufactured by Hitachi Ltd.). A toner with an external additive externally added thereto is observed and scaled up by a magnification of up to 200,000. In this field, a maximum diameter of each of 100 primary particles of the external additive is measured at random. The number-average particle diameter is calculated from a distribution of the maximum diameter obtained by the measurement. The observation magnification is appropriately adjusted depending on the size of the external additive.

<Method of Measuring Weight Average Particle Diameter (D4)>

The weight average particle diameter (D4) of the magnetic toner particles was calculated by: performing measurement at a number of effective measurement channels of 25,000 using a precision particle size distribution measuring apparatus based on a pore electrical resistance method provided with a 100-μm aperture tube "Coulter Counter Multisizer 3" (trademark, manufactured by Beckman Coulter, Inc), and dedicated software included thereto "Beckman Coulter Multisizer 3 Version 3.51" (manufactured by Beckman Coulter, Inc) for setting measurement conditions and analyzing measurement data; and analyzing the measurement data.

An electrolyte aqueous solution prepared by dissolving special grade sodium chloride in ion-exchanged water to have a concentration of about 1 mass %, for example, an "ISOTON II" (manufactured by Beckman Coulter, Inc) can be used in the measurement.

It should be noted that the dedicated software was set as described below prior to the measurement and the analysis.

In the "change standard measurement method (SOM) screen" of the dedicated software, the total count number of a control mode is set to 50,000 particles, the number of times of measurement is set to 1, and a value obtained by using "standard particles each having a particle diameter of 10.0

μm" (manufactured by Beckman Coulter, Inc) is set as a Kd value. A threshold and a noise level are automatically set by pressing a threshold/noise level measurement button. In addition, a current is set to 1,600 μA, a gain is set to 2, and an electrolyte solution is set to an ISOTON II, and a check mark is placed in a check box as to whether the aperture tube is flushed after the measurement.

In the "setting for conversion from pulse to particle diameter screen" of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte aqueous solution are charged into a 250-ml round-bottom beaker made of glass dedicated for the Multisizer 3. The beaker is set in a sample stand, and the electrolyte aqueous solution in the beaker is stirred with a stirrer rod at 24 rotations/sec in a counter-clockwise direction. Then, dirt and bubbles in the aperture tube are removed by the "aperture flush" function of the analysis software.

(2) About 30 ml of the electrolyte aqueous solution are charged into a 100-ml flat-bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three mass fold is added as a dispersant to the electrolyte aqueous solution.

(3) A predetermined amount of ion-exchanged water is charged into the water tank of an ultrasonic dispersing unit "Ultrasonic Dispersion System Tetora 150" (manufactured by Nikkaki Bios Co., Ltd.) in which two oscillators each having an oscillatory frequency of 50 kHz are built so as to be out of phase by 180° and which has an electrical output of 120 W. About 2 ml of the Contaminon N are charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate to the fullest extent possible.

(5) About 10 mg of toner particles are gradually added to and dispersed in the electrolyte aqueous solution in the beaker in the section (4) in a state where the electrolyte aqueous solution is irradiated with an ultrasonic wave. Then, the ultrasonic dispersion treatment is continued for an additional 60 seconds. It should be noted that the temperature of water in the water tank is appropriately adjusted so as to be 10° C. or higher and 40° C. or lower upon ultrasonic dispersion.

(6) The electrolyte aqueous solution in the section (5) in which the toner particles have been dispersed is dropped with a pipette to the round-bottom beaker in the section (1) placed in the sample stand, and the measured concentration is adjusted to about 5%. Then, measurement is performed until the particle diameters of 50,000 particles are measured.

(7) The measurement data is analyzed with the dedicated software included with the apparatus, and the weight average particle diameter (D4) is calculated. It should be noted that an "average diameter" on the analysis/volume statistics (arithmetic average) screen of the dedicated software when the dedicated software is set to show a graph in a vol % unit is the weight average particle diameter (D4).

<Measurement Method for Average Circularity of Toner Particles>

The average circularity of toner particles is measured under measurement and analysis conditions at the time of correction operation with a flow-type particle image analyzer "FPIA-3000" (manufactured by SYSMEX CORPORATION).

A specific measurement method is as described below. First, about 20 ml of ion-exchanged water from which an impure solid and the like have been removed in advance are charged into a container made of glass. About 0.2 ml of a diluted solution prepared by diluting a "Contaminon N" (a 10-mass % aqueous solution of a neutral detergent for washing a precision measuring unit formed of a nonionic surfactant, an anionic surfactant, and an organic builder and having a pH of 7, manufactured by Wako Pure Chemical Industries, Ltd.) with ion-exchanged water by about three mass fold is added as a dispersant to the container. Further, about 0.02 g of a measurement sample is added to the container, and then the mixture is subjected to dispersion treatment with an ultrasonic dispersing unit for 2 minutes so that a dispersion liquid for measurement may be obtained. At that time, the dispersion liquid is appropriately cooled so as to have a temperature of 10° C. or more and 40° C. or less. A desktop ultrasonic cleaning and dispersing unit having an oscillatory frequency of 50 kHz and an electrical output of 150 W (such as a "VS-150" (manufactured by VELVO-CLEAR)) is used as the ultrasonic dispersing unit. A predetermined amount of ion-exchanged water is charged into a water tank, and about 2 ml of the Contaminon N are added to the water tank.

The flow-type particle image analyzer mounted with an "UPlanApro" (magnification: 10, numerical aperture: 0.40) as an objective lens was used in the measurement, and a particle sheath "PSE-900A" (manufactured by SYSMEX CORPORATION) was used as a sheath liquid. The dispersion liquid prepared according to the procedure is introduced into the flow-type particle image analyzer, and 3,000 toner particles are subjected to measurement according to the total count mode of an HPF measurement mode. Then, the average circularity of the toner particles is determined with a binarization threshold at the time of particle analysis set to 85% and particle diameters to be analyzed limited to ones each corresponding to a circle-equivalent diameter of 2.954 μm or more and less than 39.69 μm.

On the measurement, automatic focusing is performed with standard latex particles (obtained by diluting, for example, "RESEARCH AND TEST PARTICLES Latex Microsphere Suspensions 5200A" manufactured by Duke Scientific with ion-exchanged water) prior to the initiation of the measurement. After that, focusing is preferably performed every two hours from the initiation of the measurement.

It should be noted that in Examples of the present application, a flow-type particle image analyzer which had been subjected to a calibration operation by SYSMEX CORPORATION and received a calibration certificate issued by SYSMEX CORPORATION was used. The measurement was performed under measurement and analysis conditions identical to those at the time of the reception of the calibration certificate except that particle diameters to be analyzed were limited to ones each corresponding to a circle-equivalent diameter of 2.954 μm or more and less than 39.69 μm.

<Measurement of Average Surface Roughness of Magnetic Toner Particles>

In the present invention, the average surface roughness of the magnetic toner particles is measured with a scanning probe microscope. An example of the measurement method is described below.

Probe station: SPI3800N (manufactured by Seiko Instruments Inc.)

Measuring unit: SPA400

Measurement mode: DFM (resonance mode) topographic image

Cantilever: SI-DF40P

Resolutions: X data number: 256, Y data number: 128

In the present invention, an area of 1 μm square on the surface of a magnetic toner particle is measured. An area to be measured is defined as an area of 1 μm square in a center portion of a magnetic toner particle to be measured with a scanning probe microscope. A magnetic toner particle to be measured is selected at random from magnetic toner particles having a weight average particle diameter (D4) equal to that measured by a Coulter-counter method. The measured data is subjected to secondary correction. Five or more different magnetic toner particles are measured, and an average value of the obtained data is calculated as an average surface roughness of the magnetic toner particles.

In the case of measuring the surface of a magnetic toner particle in a magnetic toner in which an external additive is externally added to a magnetic toner particle through use of the scanning probe microscope, it is necessary to remove the external additive. As a specific method, for example, there is given the following method.

(1) 45 mg of the magnetic toner are put in a sample bottle, and 10 mL of methanol are added thereto.

(2) The sample is dispersed with an ultrasonic cleaner for 1 minute to separate the external additive.

(3) The resultant is subjected to suction filtration (membrane filter of 10 μm) to separate magnetic toner particles from the external additive.

Alternatively, only a supernatant may be separated by bringing a magnet into contact with the bottom of the sample bottle so as to fix the magnetic toner particles.

(4) The above-mentioned steps (2) and (3) are performed three times in total, and the magnetic toner particles thus obtained are sufficiently dried with a vacuum drier at room temperature.

The magnetic toner particles with the external additive removed therefrom are observed with a scanning electron microscope to confirm that the external additive has been removed, and thereafter the surface of each magnetic toner particle can be observed with the scanning probe microscope. In the case where the external additive has not been removed sufficiently, the steps (2) and (3) are repeated until the external additive is sufficiently removed, and thereafter the surface of each magnetic toner particle is observed with the scanning probe microscope.

As another method of removing the external additive replacing the above-mentioned steps (2) and (3), there is given a method of dissolving an external additive with an alkali solution. It is preferred that the alkali solution be a sodium hydroxide aqueous solution.

The terms as used herein are described below.

Average Surface Roughness (Ra)

A center line average roughness Ra defined under JIS B 0601 extended three-dimensionally so as to be applied to a measurement surface. The average surface roughness (Ra) is a value obtained by averaging absolute values of deviations from a reference surface to a designated surface, represented by the following equation.

$$Ra = \frac{1}{S_0}\int_{T_B}^{Y_T}\int_{X_L}^{X_R}|F(X, Y) - Z_0|dXdY$$

F(X,Y): surface representing entire measurement data $S_0$: area assuming that designated surface is ideally flat $Z_0$: average value of Z data in designated surface The designated surface means a measurement area of 1 μm square in the present invention.

<Method of Measuring Total Coverage Rate of First External Additive and Second External Additive on Surface of Magnetic Toner>

The total coverage rate of the first external additive and the second external additive on the surface of the magnetic toner in the present invention is calculated from the amount of atoms derived from the first external additive and the second external additive present on the surface of the magnetic toner measured by ESCA (X-ray photoelectron spectroscopy). The ESCA is an analysis method involving detecting an atom in a region of several nm or less in a depth direction of a sample surface. Therefore, the ESCA is capable of detecting an atom on a surface of a magnetic toner. As a sample holder, a platen (equipped with a screw hole having a diameter of about 1 mm for fixing a sample) measuring 75 mm per side, which comes with a device, is used. The screw hole passes through the platen, and hence is closed with a resin or the like to create a recess having a depth of about 0.5 mm for measuring powder. The recess is filled with a measurement sample with a spatula or the like, followed by scraping off the measurement sample by rubbing of the spatula, whereby a sample is prepared.

The device and measurement conditions for ESCA are as follows.

Used device: Quantum 2000 manufactured by ULVAC-PHI, Inc.

Analysis method: narrow analysis

Measurement Conditions:

X-ray source: Al-Kα

X-ray conditions: beam diameter: 100 μm, 25 W, 15 kV

Photoelectron acceptance angle: 45°

Pass Energy: 58.70 eV

Measurement range: φ100 μm

Measurement is performed under the above-mentioned conditions. Herein, an example using silica as external additive is described.

In an analysis method, first, a peak derived from a C—C bond of a carbon is orbital is corrected to 285 eV. Then, a Si amount derived from silica with respect to the total amount of constituent elements is calculated from a peak area derived from a silicon 2p orbital whose peak top is detected at 100 eV or more and 105 eV or less through use of a relative sensitivity factor provided by ULVAC-PHI, Inc.

First, a measurement method in the case of using silica as each of the first and second external additives is described below.

A Si amount derived from silica with respect to the total amount of constituent elements is determined by subjecting a magnetic toner with silica externally added thereto to measurement by the ESCA. Next, a Si amount derived from silica with respect to the total amount of constituent elements is determined by subjecting silica applied to the magnetic toner alone to measurement. The Si amount obtained by subjecting silica alone to measurement is defined as a 100% external additive coverage rate on the surface of the magnetic toner, and the ratio of the Si amount obtained by subjecting the magnetic toner to measurement with respect to the Si amount of silica alone is defined as the total coverage rate in the present invention.

On the other hand, the first external additive to be used in the present invention is organic-inorganic composite fine particles, and hence the total coverage rate is determined by a measurement procedure different from the above-mentioned measurement method.

(1) First, only the organic-inorganic composite fine particles serving as the first external additive are externally added to the surface of each magnetic toner particle, and a Si amount derived from silica is determined by the ESCA. Next, a Si amount derived from silica is determined by subjecting the organic-inorganic composite fine particles alone to measurement by the ESCA under the above-mentioned conditions, and the coverage rate of the organic-inorganic composite fine particles on the surface of the magnetic toner particle is determined. Five samples with the organic-inorganic composite fine particles alone externally added thereto are prepared, and a calibration line of the coverage rate of the organic-inorganic composite fine particles is obtained.

(2) Similarly, only silica fine particles serving as the second external additive are externally added to the surface of each magnetic toner particle, and a Si amount derived from silica is determined by the ESCA. Next, a Si amount derived from silica is determined by subjecting the second external additive alone to measurement by the ESCA under the above-mentioned conditions, and the coverage rate of the second external additive on the surface of the magnetic toner particle is determined. Five samples with the second external additive alone externally added thereto are prepared, and a calibration line of the coverage rate of the second external additive is obtained.

(3) Next, the first external additive and the second external additive are externally added to the surface of each magnetic toner surface in desired parts by mass, and a Si amount (actually measured value) derived from silica is determined by the ESCA.

(4) Then, a coverage rate and a Si amount (each of which is a calculated value) derived from the organic-inorganic composite fine particles are determined from the parts by mass of the first external additive externally added to the surface of each magnetic toner particle through use of the calibration line obtained previously.

(5) A Si amount (calculated value) derived from the second external additive is determined from the Si amounts determined in the above-mentioned steps (3) and (4).

(6) A coverage rate derived from the second external additive externally added to the surface of each magnetic toner particle is determined from the calibration line of the second external additive obtained in the above-mentioned step (2) and the Si amount (calculated value) derived from the second external additive obtained in the above-mentioned step (5).

(7) A value obtained by summing the coverage rate derived from the first external additive and the coverage rate derived from the second external additive (each of which is a calculated value) obtained in the above-mentioned steps (4) and (6) is defined as the total coverage rate of the first external additive and the second external additive on the surface of the magnetic toner.

In the case of using inorganic fine particles other than silica, except that "Si amount" is change to "amount of the inorganic element contained in the inorganic fine particles", this method can be used.

<Method of Measuring Surface Existence Ratio of Inorganic Fine Particles in Organic-Inorganic Composite Fine Particles>

A method of measuring the surface existence ratio of inorganic fine particles in organic-inorganic composite fine particles is performed by the ESCA, and a device, measurement conditions, and an analysis method are also as described above.

First, organic-inorganic composite fine particles are measured. Further, inorganic fine particles forming the organic-inorganic composite fine particles are measured by the same method. In the case where the inorganic fine particles are silica, the ratio of a Si amount obtained by measuring the organic-inorganic composite fine particles with respect to a Si amount obtained by measuring the silica particles is defined as the surface existence ratio of the inorganic fine particles in the organic-inorganic composite fine particles in the present invention. As the silica particles, for example, colloidal silica particles (number-average particle diameter: 101 nm) descried in a production example are used for calculation.

Note that, in the case where the external additive is silica alone, a silica existence ratio is 100%, and in the case where surface treatment is not particularly performed, a silica existence ratio of resin particles is 0%.

<Method of Measuring Shear Load>

A shear load (i.e. the shear load defined in claim 1) measured at a time when a disc-shaped disc is pressed against the surface of a consolidated toner powder layer in the present invention is measured with a powder fluidity analysis device (FT-4, manufactured by Freeman Technology Ltd.) equipped with a rotary propeller-type blade and a rotary disc-shaped disc-type blade.

Figure 1B:
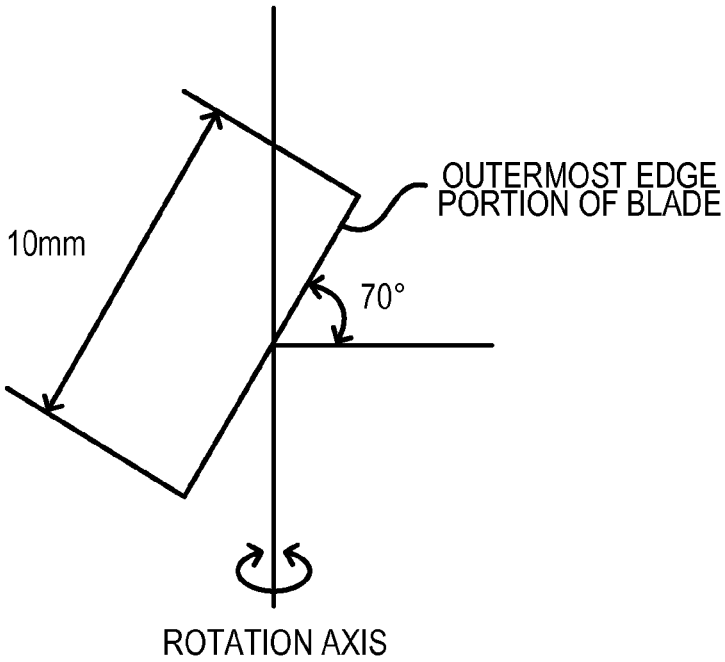
FIG. 1B is an explanatory diagram of a propeller-type blade to be used for measurement of a shear load value.
Figure 2:
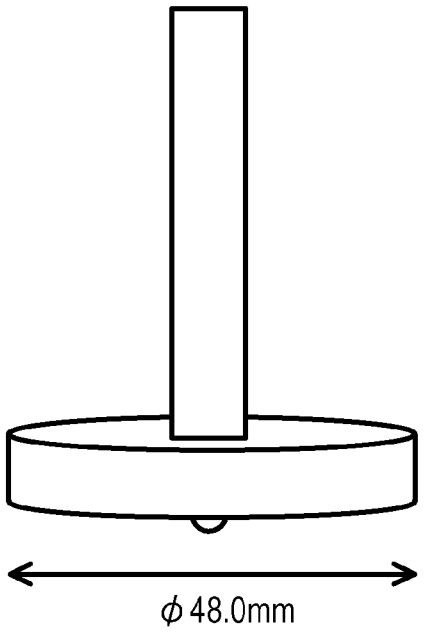
FIG. 2 is an explanatory diagram of a disc-shaped disc-type blade to be used for measurement of a shear load value.
Figure 2:
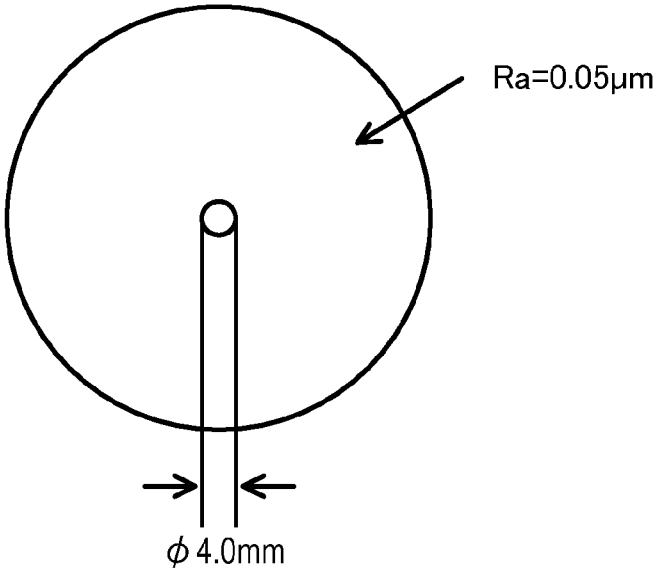

Specifically, the shear load is measured by the following operation. Note that, in the operation, the propeller-type blade to be used is a blade having a diameter of 48.0 mm dedicated for FT-4 measurement (see FIGS. 1A and 1B; a rotation axis is present in a normal direction at the center of a blade plate of 48 mm×10 mm; both outermost edge portions (portions of 24 mm from the rotation axis) of the blade plate and portions of 12 mm from the rotation axis of the blade plate are smoothly twisted by 70° and 35° respectively in a counterclockwise direction; the propeller-type blade is made of stainless steel (SUS). Hereinafter the propeller-type blade is sometimes abbreviated as "blade"). Further, the shear load is measured through use of the disc-shaped disc-type blade (see FIG. 2; the disc-shaped disc-type blade has a diameter of 48.0 mm and a thickness of 1.5 mm and is made of SUS. Hereinafter the disc-shaped disc-type blade is sometimes abbreviated as "disc"). Note that a polyethylene terephthalate (PET) sheet is bonded to the surface of the disc, and further a film subjected to NANOS coating (manufactured by T&K Corporation) is bonded to the surface of the PET sheet.

60 g of magnetic toner left to stand in an environment at a temperature of 23° C. and a humidity of 60% for 3 or more days are put in a cylindrical split container having a diameter of 50 mm and a capacity of 85 mL dedicated for FT-4 measurement (height from the bottom of the container to a split portion is 43 mm, and the material is glass. Hereinafter the split container is sometimes abbreviated as "measurement container" or "container") to obtain a powder layer (toner powder layer).

[a] Conditioning Operation

The blade is inserted from the surface of the powder layer to a position of 10 mm from the bottom of the powder layer in a clockwise rotation direction (direction in which the powder layer is disentangled by the rotation of the blade) with respect to the surface of the powder layer, with the rotation speed of the blade being set to a circumferential velocity of an outermost edge portion of the blade of 60 mm/sec, and the insertion speed in a vertical direction to the powder layer being set to a speed so that an angle formed by a path drawn by the outermost edge portion of the moving blade and the surface of the powder layer is 5 (deg) (hereinafter sometimes abbreviated as "formed angle").

After that, the blade is moved to a position of 1 mm from the bottom of the magnetic powder layer in a clockwise rotation direction with respect to the surface of the powder layer, with the rotation speed of the blade being 40 (m/sec), and the movement speed in the vertical direction to the powder layer being set to a speed so that a formed angle becomes 2 (deg). Then, the blade is moved to a position of 80 mm from the bottom of the powder layer in a counterclockwise rotation direction with respect to the surface of the powder layer, with the rotation speed of the blade being set to 60 (mm/sec), and a removal speed of the blade from the powder layer being set to a speed so that a formed angle becomes 5 (deg), whereby the blade is removed. When the blade has been removed, a toner adhering to the blade is shaken off by rotating the blade both in the clockwise and counterclockwise directions alternately on a small scale.

[b] Consolidation Operation of Magnetic Toner

For compressing a magnetic toner, a piston for a compression test (diameter: 48.0 mm, height: 20 mm; lower portion is meshed) is used in place of the propeller-type blade and inserted into a powder layer from a height of 80 mm of the bottom of the powder layer at an insertion speed in a vertical direction of 0.5 mm/sec. The piston is inserted into the powder layer until a load required for insertion reaches 0.55 kPa. After the load has reached 0.55 kPa, the insertion speed of the piston is changed to 0.04 mm/sec, and the piston is inserted until a load required for insertion reaches 9.0 kPa. After the load has reached 9.0 kPa, the magnetic toner is consolidated in that state for 60 seconds.

[c] Split Operation

Toner powder layers of the same volume (43 mL) are formed by scraping off a toner powder layer in a split portion of the container dedicated for FT-4 measurement to remove a toner in an upper portion of the toner powder layer.

[d] Measurement Operation (1) Subsequently, the piston for a compression test is replaced by a disc blade (disc-shaped disc) serving as a blade for measuring a wall surface friction, and the powder layer is consolidated again until a load required for insertion reaches 9.0 kPa, with the insertion speed in a vertical direction being set to 0.08 mm/sec.

(2) After that, while the powder layer is being consolidated, the disc blade is rotated at a speed of ($\pi$/10 rad)/min by $\pi$/3 (rad) in a clockwise direction with respect to the surface of the powder layer, whereby a preliminary shear is applied to the surface of the powder layer.

(3) Next, the rotation is stopped, and only a vertical load of 9.0 kPa is applied to the powder layer, whereby the powder layer is put in a standby state for 25 (sec).

(4) After the standby, a shear load calculated from a rotation torque is measured at a time when the disc blade is rotated at a speed of ($\pi$/10 rad)/min by $\pi$/36 rad in a clockwise rotation direction with respect to the surface of the magnetic toner powder layer.

(5) Subsequently, the vertical load is changed to 7.0 kPa to put the powder layer in a standby state for 25 (sec). After the standby, a shear load calculated from a rotation torque is measured at a time when the disc blade is rotated at a speed of ($\pi$/10 rad)/min by $\pi$/36 rad in a clockwise rotation direction with respect to the surface of the magnetic toner powder layer.

(6) A shear load value calculated at 5.0 kPa is read by performing the operation of (5) under vertical loads of 6.0 kPa, 5.0 kPa, 4.0 kPa, and 3.0 kPa.

<Method of Measuring Zeta Potential>

The zeta potential ($\zeta$(T)) of the magnetic toner particles and the zeta potential ($\zeta$(A1)) of the first external additive were measured through use of a zeta sizer Nano-Zs (manufactured by Sysmex Corporation).

$\zeta$(T) was measured through the following procedure.

0.1 g of the magnetic toner particles was added to 9.9 g of methanol (manufactured by Kishida Chemical Co., Ltd.) and dispersed with an ultrasonic disperser (manufactured by Nippon Rikagaku Kikai Co., Ltd.) for 5 minutes to prepare a dispersion. The dispersion was supplied to a DTS1060C-Clear Disposable Zeta Cell which came with the device through use of a dropper so that air bubbles were not generated. The cell was mounted on a measurement unit, and a zeta potential was measured at 25° C. This measurement was performed, and an arithmetic average value of three measurements was defined as $\zeta$(T) in the present invention.

Subsequently, $\zeta$(A1) was measured by the following procedure.

0.1 g of the first external additive was added to 9.9 g of methanol (manufactured by Kishida Chemical Co., Ltd.) and dispersed with an ultrasonic disperser (manufactured by Nippon Rikagaku Kikai Co., Ltd.) for 5 minutes to prepare a dispersion. In the case where a white precipitate and supernatant of the first external additive are recognized visually in the dispersion, the addition amount of a TRITON X-100 (nonionic surfactant, manufactured by The Dow Chemical Company) aqueous solution is appropriately adjusted. The dispersion was supplied to a DTS1060C-Clear Disposable Zeta Cell which came with the device through use of a dropper so that air bubbles were not generated. The cell was mounted on a measurement unit, and a zeta potential was measured at 25° C. This measurement was performed, and an arithmetic average value of three measurements was defined as (A1) in the present invention.

For example, in the case of measuring zeta potentials of magnetic toner particles and an external additive from a magnetic toner with an external additive externally added thereto, the magnetic toner particles and the external additive are separated from the magnetic toner and can be respectively measured for a zeta potential. The magnetic toner is ultrasonically dispersed in methanol to remove the external additive therefrom and left to stand for 24 hours. The precipitated magnetic toner particles and the external additive dispersed in a supernatant are separated from each other and collected, and sufficiently dried, whereby the magnetic toner particles and the external additive can each be isolated. In the case where a plurality of external additives is externally added to a magnetic toner, a supernatant may be separated by a centrifugal method to be isolated for measurement.

<Method of Quantifying Organic-Inorganic Composite Fine Particles in Magnetic Toner>

In the case of measuring the content of organic-inorganic composite fine particles in a magnetic toner in which a plurality of external additives is externally added to magnetic toner particles, it is necessary to remove the external additives from the magnetic toner particles, and further to isolate and collect the plurality of external additives.

As a specific method, for example, there is given the following method.

(1) 5 g of the magnetic toner is put in a sample bottle, and 200 mL of methanol are added thereto. As needed, several drops of a surfactant are added to the resultant. As the surfactant, a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) can be used.

(2) The sample is dispersed with an ultrasonic cleaner for 5 minutes to separate the external additives.

(3) The magnetic toner particles and the external additives are separated by suction filtration (membrane filter of 10 μm). Alternatively, only a supernatant may be separated by bringing a neodymium magnet into contact with the bottom of the sample bottle so as to fix the magnetic toner particles.

(4) The above-mentioned steps (2) and (3) are performed three times in total.

The externally added external additives are isolated from the magnetic toner particles by the above-mentioned operation. The collected aqueous solution is supplied to a centrifugal machine, whereby the silica fine particles and the organic-inorganic composite fine particles are separated and collected. Then, the solvent is removed, and the resultant is dried sufficiently with a vacuum drier. The resultant is measured for its mass to determine the content of the organic-inorganic composite fine particles.

EXAMPLES

Hereinafter the present invention is described specifically by way of Examples. However, the embodiments of the present invention are by no means limited to Examples below. In Examples, "part(s)" refers to "part(s) by mass".

<Production Example of Organic-Inorganic Composite Fine Particles 1 to 7 and 9>

Organic-inorganic composite fine particles can be produced according to the description of Examples in International Publication No. WO 2013/063291.

As organic-inorganic composite fine particles 1 to 7 and 9 to be used in Examples described later, those which are produced according to Example 1 of International Publication No. WO 2013/063291 through use of silica shown in Table 1 are prepared. Note that the organic-inorganic composite fine particles 1 to 7 and 9 each had a structure in which inorganic fine particles are embedded to resin particle and the surface of the organic-inorganic composite fine particles had a plurality of convexes derived from inorganic fine particles. Table 1 shows physical properties of the organic-inorganic composite fine particles 1 to 7 and 9.

<Production Example of Organic-Inorganic Composite Fine Particles 8>

Organic-inorganic composite fine particles 8 can be produced according to the description of Examples of Japanese Patent Application Laid-Open No. 2005-202131. Note that the organic-inorganic composite fine particles 8 had a structure in which inorganic fine particles are embedded to resin particle and the surface of the organic-inorganic composite fine particles had a plurality of convexes derived from inorganic fine particles. Table 1 shows physical properties of the organic-inorganic composite fine particles 8.

<Production Example of Inorganic Particles 1>

Inorganic particles 1 are obtained by hydrophobizing the surfaces of silica fine particles obtained by a general sol-gel method with hexamethyldisilazane. Table 2 shows physical properties thereof.

<Production Example of Inorganic Particles 2>

As inorganic particles 2, those which are obtained by hydrophobizing the surfaces of silica fine particles having a BET specific surface area of 40 $m^2/g$ and a primary particle diameter of 138 nm obtained by a general fumed method with hexamethyldisilazane are used. Table 2 shows physical properties thereof.

<Inorganic Particles 3>

As inorganic particles 3, those which are obtained by hydrophobizing the surface of a silica technical product having a BET specific surface area of 200 $m^2/g$ and a primary particle diameter of 15 nm obtained by the fumed method with hexamethyldisilazane are used.

<Inorganic Particles 4>

As inorganic particles 4, those which are obtained by hydrophobizing the surface of a silica technical product having a BET specific surface area of 130 $m^2/g$ and a primary particle diameter of 25 nm obtained by the fumed method with hexamethyldisilazane are used.

<Inorganic Particles 5>

As inorganic particles 5, those which are obtained by hydrophobizing the surface of a silica technical product having a BET specific surface area of 300 $m^2/g$ and a primary particle diameter of 10 nm obtained by the fumed method with hexamethyldisilazane are used.

<Organic Particles 1>

As organic particles 1, EPOSTAR manufactured by Nippon Shokubai Co., Ltd. is used.

TABLE 1

| | Composition | | | | | |
|---|---|---|---|---|---|---|
| | Inorganic fine particles to be contained | Resin component to be contained | Number-average particle diameter of inorganic fine particles (nm) | Ratio of inorganic fine particles (mass %) | Number-average particle diameter (nm) | Zeta potential (mV) |
| Organic-inorganic composite fine particles 1 | Colloidal silica | MPS polymer | 25 | 67 | 106 | −33.0 |
| Organic-inorganic composite fine particles 2 | Colloidal silica | MPS polymer | 15 | 46 | 99 | −24.1 |
| Organic-inorganic composite fine particles 3 | Colloidal silica | MPS polymer | 15 | 64 | 62 | −25.0 |

TABLE 1-continued

| | Composition | | | | | |
|---|---|---|---|---|---|---|
| | Inorganic fine particles to be contained | Resin component to be contained | Number-average particle diameter of inorganic fine particles (nm) | Ratio of inorganic fine particles (mass %) | Number-average particle diameter (nm) | Zeta potential (mV) |
| Organic-inorganic composite fine particles 4 | Colloidal silica | MPS polymer | 25 | 45 | 130 | −37.0 |
| Organic-inorganic composite fine particles 5 | Colloidal silica | MPS polymer | 25 | 66 | 190 | −30.9 |
| Organic-inorganic composite fine particles 6 | Colloidal silica | MPS polymer | 15 | 45 | 104 | −31.0 |
| Organic-inorganic composite fine particles 7 | Colloidal silica | MPS polymer | 50 | 50 | 200 | −7.2 |
| Organic-inorganic composite fine particles 8 | Colloidal silica | Melamine | 8 | 9 | 250 | −6.3 |
| Organic-inorganic composite fine particles 9 | Colloidal silica | MPS polymer | 60 | 30 | 335 | −32.5 |

MPS: methacryloxypropyltrimethoxysilane

TABLE 2

Various physical properties of external additives used in the present invention

| Other additive | Kind | Number-average particle diameter (nm) | Zeta potential (mV) |
|---|---|---|---|
| Inorganic particles 1 | Colloidal silica | 101 | −6.8 |
| Inorganic particles 2 | Fumed silica | 138 | −17.5 |
| Inorganic particles 3 | Fumed silica | 15 | — |
| Inorganic particles 4 | Fumed silica | 25 | — |
| Inorganic particles 5 | Fumed silica | 10 | — |
| Organic particles 1 | EPOSTAR | 290 | 0.5 |

<Production Example of Magnetic Toner Particles 1>

| | |
|---|---|
| Polyester resin | 100 parts |
| Magnetic iron oxide particles (magnetic material) | 60 parts |
| Polyethylene wax (PW2000: manufactured by Toyo-Petrolite Co., Ltd., melting point: 120° C.) | 4 parts |
| Charge-controlling agent (T-77: manufactured by Hodogaya Chemical Co., Ltd.) | 2 parts |

The above-mentioned materials were premixed with a Henschel mixer. The mixture was melted and kneaded with a two-axial extruder heated to 110° C., and the cooled kneaded product was roughly pulverized with a hammer mill to obtain a toner roughly pulverized product. The obtained roughly pulverized product was finely pulverized by mechanical pulverization through use of a mechanical pulverizer Turbo Mill (manufactured by Turbo Kogyo Co., Ltd.; each surface of a rotator and a stator is coated with a chromium alloy plating containing chromium carbide (plating thickness: 150 μm; surface hardness: HV1050). Fine powder and rough powder were simultaneously removed from the obtained finely pulverized product by classification through use of a multi-division classifier ("Elbow-Jet Classifier" manufactured by Nittetsu Mining Co., Ltd.) using the Coanda effect. After classification, the resultant was subjected to particle surface treatment through use of a surface modifying device "Faculty F-600" (manufactured by Hosokawa Micron Corporation) to modify the surface and remove fine powder. As a result of the above-mentioned steps, magnetic toner particles 1 having a weight average particle diameter (D4) of 6.9 μm, an average circularity of 0.957, and an average surface roughness (Ra) of 10.6 nm as shown in Table 3 were obtained.

<Production Example of Magnetic Toner Particles 2>

Magnetic toner particles 2 having a weight average particle diameter (D4) of 6.9 μm, an average circularity of 0.956, and an average surface roughness (Ra) of 12.1 nm were obtained in the same way as in the production example of the magnetic toner particles 1 except that the amount of magnetic iron oxide particles was set to 45 parts, and the outlet temperature of the surface modifying device was decreased.

<Production Example of Magnetic Toner Particles 3>

Magnetic toner particles 3 having a weight average particle diameter (D4) of 6.8 μm, an average circularity of 0.957, and an average surface roughness (Ra) of 9.1 nm were obtained in the same way as in the production example of the magnetic toner particles 1 except that the amount of magnetic iron oxide particles was set to 95 parts, and the outlet temperature of the surface modifying device was increased.

<Production Example of Magnetic Toner Particles 4>

Magnetic toner particles 4 having a weight average particle diameter (D4) of 7.2 μm, an average circularity of 0.944, and an average surface roughness (Ra) of 23.9 nm were obtained in the same way as in the production example of the magnetic toner particles 1 except that the rotation velocity of a dispersion rotor of the surface modifying device was decreased.

<Production Example of Magnetic Toner Particles 5>

450 parts of a 0.1 mol/L $Na_3PO_4$ aqueous solution were supplied to 720 parts of ion-exchanged water, and the mixture was heated to 60° C. After that, 67.7 parts of a 1.0 mol/L $CaCl_2$ aqueous solution were added to the resultant to obtain an aqueous medium containing a dispersion stabilizer ($Ca_3(PO_4)_2$).

| | |
|---|---|
| Styrene | 74.00 parts |
| n-Butyl acrylate | 26.00 parts |
| Divinylbenzene | 0.52 part |
| Iron complex of monoazo dye (T-77: manufactured by Hodogaya Chemical Co., Ltd.) | 1.00 part |
| Hydrophobized magnetic material | 90.00 parts |
| Amorphous polyester | 3.00 parts |

(Saturated polyester resin obtained by a condensation reaction of an ethylene oxide adduct of bisphenol A and terephthalic acid; Mn=5,000, acid number=12 mgKOH/g, Tg=68° C.)

The above-mentioned components were uniformly dispersed and mixed through use of an attritor (manufactured by Mitsui Mining Co., Ltd.) to obtain a monomer composition. The monomer composition was heated to 60° C., and 15.0 parts of a paraffin wax (endothermic peak top temperature: 77.2° C.) were mixed and dissolved in the monomer composition. Then, 4.5 parts of a polymerization initiator 2,2'-azobis(2,4-dimethylvaleronitrile) were dissolved in the resultant.

The monomer composition was supplied to the aqueous medium, and the mixture was stirred at 12,000 rpm with CLEARMIX (manufactured by M Technique Co., Ltd.) at 60° C. in an atmosphere of $N_2$ for 15 minutes to granulate particles. Then, the resultant was heated to 70° C. at a rate of 0.5° C./min while stirring with a paddle stirring blade, and reacted for 5 hours while being kept at 70° C. After that, the resultant was increased in temperature to 90° C. and kept for 2 hours. After the completion of the reaction, a suspension was cooled, and $Ca_3(PO_4)_2$ was dissolved by adding hydrochloric acid thereto. The resultant was filtered, washed with water, and dried, whereby magnetic toner particles 5 having a weight average particle diameter (D4) of 8.0 μm, an average circularity of 0.979, and an average surface roughness (Ra) of 2.8 nm as shown in Table 3 were obtained.

<Production Example of Magnetic Toner Particles 6>

Magnetic toner particles 6 having a weight average particle diameter (D4) of 7.1 μm, an average circularity of 0.925, and an average surface roughness (Ra) of 51.2 nm were obtained in the same way as in the production example of the magnetic toner particles 1 except that the addition amount of magnetic iron oxide particles was changed to 95 parts, and the surface modifying device was not used.

TABLE 3

Physical properties of magnetic toner particles

| | Magnetic toner particles | | | | | |
|---|---|---|---|---|---|---|
| | (1) | (2) | (3) | (4) | (5) | (6) |
| Weight average particle diameter (D4): μm | 6.9 | 6.9 | 6.8 | 7.2 | 8.0 | 7.1 |
| Average circularity; — | 0.957 | 0.956 | 0.957 | 0.944 | 0.979 | 0.925 |
| ζ potential (mV) | −62.5 | −68.7 | −58.4 | −63.4 | −58.4 | −59.8 |
| Average surface roughness (Ra); nm | 10.6 | 12.1 | 9.1 | 23.9 | 2.8 | 51.2 |

<Production of Magnetic Toner>

Example 1

1.1 parts of the organic-inorganic composite fine particles 1 serving as a first external additive and 0.5 part of the inorganic particles 3 serving as a second external additive were externally added to and mixed with 100 parts of the magnetic toner particles 1 with a Henschel mixer, and the mixture was sifted through a mesh having an opening of 100 μm to obtain a negatively triboelectrically chargeable magnetic toner 1. Table 4 shows various physical properties of the obtained magnetic toner 1.

[Evaluation Items]

HP LaserJet Enterprise600 M603dn was remodeled to a process speed of 400 mm/s to be used, considering the further increase in speed and increase in life of a printer in the future.

A predetermined process cartridge was filled with 982 g of the magnetic toner 1. An image-forming test of 42,000 sheets in total was conducted in a mode set so that a subsequent job starts after a machine once stops between jobs, with one job being two sheets of a horizontal line pattern that was to have a printing ratio of 2%.

Note that image-forming evaluation was made in a high-temperature and high-humidity environment (32.5° C./80% RH).

Transfer Efficiency

Transfer efficiency was evaluated as follows.

After the passage of 100 sheets of images, the main body is adjusted so that a toner laid-on level on a photosensitive member reaches 0.8 mg/cm$^2$ after the passage of 42,000 sheets, and a test pattern is output. Then, the main body is forcefully stopped before the test pattern is fixed onto a recording sheet.

A recording sheet is taken out from the main body which has been forcefully stopped, and a toner is collected by attaching a transparent pressure-sensitive adhesive tape on a transferred test pattern portion. The toner is attached to a copy sheet together with the pressure-sensitive adhesive tape. The density of the test pattern portion is measured with an optical densitometer, and a density in a portion where only the pressure-sensitive adhesive tape has been attached to the copy sheet is subtracted from the measured density to determine a transfer density A.

The photosensitive member of the cartridge is removed, and a transfer residual toner density B is determined by the same method also with respect to a transfer residual toner.

As the pressure-sensitive adhesive tape, weakly pressure-sensitive adhesive SuperStick manufactured by Lintec Corporation is used.

As the copy sheet, GF-0081 available from Canon Marketing Japan Inc. is used.

As the optical densitometer, a spectral densitometer 504 manufactured by X-Rite Co., Ltd. is used.

The transfer efficiency of the toner is determined by the following equation.

$$\text{Transfer efficiency (\%)} = \text{Transfer density } A/(\text{transfer density } A + \text{transfer residual toner density } B) \times 100$$

The transfer efficiency in an initial stage (after the passage of 100 sheets) is evaluated as initial characteristics of the toner, and transfer efficiency after the durability test (after the passage of 42,000 sheets) is evaluated as durability of the toner. Table 5 shows the evaluation results.

Note that the evaluation criteria are as described below.

A: Transfer efficiency is 90% or more.

B: Transfer efficiency is 85% or more and less than 90%.

C: Transfer efficiency is 80% or more and less than 85%.

D: Transfer efficiency is less than 80%.

A change amount of the initial transfer efficiency and the transfer efficiency after the durability test is calculated, and durable stability is evaluated based on the change amount.

A: 0% or more and less than 3%

B: 3% or more and less than 6%

C: 6% or more and less than 9%

D: 9% or more

Sleeve Fusion

A sleeve in a developing unit is collected after the passage of 42,000 sheets, and whether or not contamination derived from an external additive is seen is visually observed and is evaluated based on the following criteria.

A: No contamination is seen.

B: Slight contamination is recognized.

C: Contamination is recognized.

D: Contamination is conspicuous.

Table 5 shows evaluation results.

Examples 2 to 11

Magnetic toners 2 to 11 were obtained in the same way as in the production example of the magnetic toner 1 except that the magnetic toner particles, the first external additive, the second external additive, and parts by mass were changed. Table 4 shows various physical properties of the obtained magnetic toners. Further, Table 5 shows results obtained by performing evaluation in the same way as in Example 1.

Comparative Examples 1 to 6

Magnetic toners 12 to 17 were obtained in the same way as in the production example of the magnetic toner 1 except that the magnetic toner particles, the first external additive, the second external additive, particle diameters, and parts by mass were changed. Table 4 shows various physical properties of the obtained magnetic toners. Further, Table 5 shows results obtained by performing evaluation in the same way as in Example 1.

TABLE 4

Construction and physical properties of magnetic toner

| | Formulation of toner particles | | | | | | | | | |
|---|---|---|---|---|---|---|---|---|---|---|
| | Magnetic toner particles | | First external additive A (organic-inorganic composite fine particles) | | | | Second external additive B (inorganic particles) | | | |
| | No. | Parts by mass | No. | Number-average particle diameter (nm) | SF-2 | Parts by mass | No. | Number-average particle diameter (nm) | Parts by mass | A/(A + B) |
| Magnetic toner 1 | 1 | 100 | 1 | 106 | 115 | 1.1 | 3 | 15 | 0.5 | 0.688 |
| Magnetic toner 2 | 1 | 100 | 1 | 104 | 116 | 0.8 | 3 | 13 | 0.5 | 0.615 |
| Magnetic toner 3 | 2 | 100 | 2 | 99 | 103 | 1.1 | 3 | 16 | 0.8 | 0.579 |
| Magnetic toner 4 | 4 | 100 | 1 | 105 | 115 | 1.0 | 3 | 14 | 1.3 | 0.435 |
| Magnetic toner 5 | 3 | 100 | 3 | 62 | 102 | 1.6 | 4 | 25 | 0.9 | 0.640 |
| Magnetic toner 6 | 5 | 100 | 4 | 130 | 107 | 2.0 | 3 | 15 | 0.9 | 0.690 |
| Magnetic toner 7 | 5 | 100 | 4 | 132 | 106 | 3.0 | 3 | 14 | 1.3 | 0.698 |
| Magnetic toner 8 | 6 | 100 | 5 | 190 | 119 | 3.5 | 3 | 15 | 0.9 | 0.795 |
| Magnetic toner 9 | 5 | 100 | 6 | 104 | 103 | 0.6 | 5 | 11 | 0.3 | 0.667 |
| Magnetic toner 10 | 5 | 100 | 3 | 65 | 103 | 0.4 | 5 | 10 | 0.3 | 0.571 |
| Magnetic toner 11 | 4 | 100 | 9 | 336 | 121 | 3.5 | 5 | 12 | 0.9 | 0.795 |
| Magnetic toner 12 | 1 | 100 | 7 | 202 | 116 | 1.1 | 3 | 15 | 0.5 | 0.688 |
| Magnetic toner 13 | 1 | 100 | 8 | 148 | 104 | 1.0 | 3 | 13 | 1 | 0.500 |
| Magnetic toner 14 | 1 | 100 | (Inorganic particles 1) | 101 | 101 | 3.2 | 3 | 14 | 0.9 | 0.780 |
| Magnetic toner 15 | 1 | 100 | (Inorganic particles 2) | 137 | 118 | 3.2 | 3 | 16 | 0.9 | 0.780 |
| Magnetic toner 16 | 1 | 100 | (Organic particles 1) | 288 | 103 | 3.5 | 3 | 17 | 0.9 | 0.795 |
| Magnetic toner 17 | 1 | 100 | — | — | — | — | 3 | 15 | 1.8 | — |

| | Surface existence ratio of | Toner physical properties | | | |
|---|---|---|---|---|---|
| | inorganic fine particle inorganic-inorganic composite fine particles (%) | Content of organic-inorganic composite fine particles (parts by mass) | Shear load (kPa) | $\lvert\zeta(T) - \zeta(A1)\rvert$ (mV) | Total coverage rate (%) |
| Magnetic toner 1 | 65.0 | 1.090 | 1.64 | 29.5 | 60.0 |
| Magnetic toner 2 | 65.0 | 0.770 | 1.80 | 29.5 | 55.6 |
| Magnetic toner 3 | 42.0 | 1.080 | 1.71 | 44.6 | 58.0 |
| Magnetic toner 4 | 65.0 | 0.970 | 1.98 | 30.4 | 65.0 |
| Magnetic toner 5 | 58.0 | 1.600 | 1.85 | 33.4 | 80.0 |
| Magnetic toner 6 | 65.0 | 1.980 | 0.57 | 21.4 | 70.1 |
| Magnetic toner 7 | 65.0 | 2.960 | 1.85 | 22.8 | 75.0 |
| Magnetic toner 8 | 61.1 | 3.480 | 1.01 | 27.5 | 70.0 |
| Magnetic toner 9 | 63.0 | 0.590 | 1.88 | 27.5 | 39.5 |
| Magnetic toner 10 | 58.0 | 0.400 | 1.98 | 33.4 | 38.0 |
| Magnetic toner 11 | 60.5 | 3.500 | 1.65 | 30.9 | 62.0 |
| Magnetic toner 12 | 50.0 | 1.100 | 2.12 | 55.3 | 58.0 |
| Magnetic toner 13 | 80.0 | 0.980 | 1.68 | 56.2 | 58.0 |
| Magnetic toner 14 | — | — | 1.72 | 51.6 | 78.9 |
| Magnetic toner 15 | — | — | 2.12 | 40.9 | 74.5 |
| Magnetic toner 16 | — | — | 2.56 | 58.9 | 64.0 |
| Magnetic toner 17 | | — | 2.01 | — | 78.0 |

TABLE 5

| Evaluation results | | | | | | | | |
|---|---|---|---|---|---|---|---|---|
| | | Transfer efficiency | | | | | | |
| | | Initial (100 sheets) | | After durability test (42,000 sheets) | | Change amount | | Sleeve fusion |
| Example 1 | Magnetic toner 1 | A | 91% | A | 90% | A | 1% | A |
| Example 2 | Magnetic toner 2 | B | 86% | B | 85% | A | 1% | A |
| Example 3 | Magnetic toner 3 | B | 88% | B | 85% | B | 3% | B |
| Example 4 | Magnetic toner 4 | C | 84% | C | 83% | A | 1% | A |
| Example 5 | Magnetic toner 5 | B | 89% | C | 83% | C | 6% | B |
| Example 6 | Magnetic toner 6 | A | 97% | A | 90% | C | 7% | C |
| Example 7 | Magnetic toner 7 | B | 88% | C | 82% | C | 6% | C |
| Example 8 | Magnetic toner 8 | A | 98% | A | 90% | C | 8% | C |
| Example 9 | Magnetic toner 9 | A | 94% | B | 88% | C | 6% | A |
| Example 10 | Magnetic toner 10 | A | 93% | B | 86% | C | 7% | A |
| Example 11 | Magnetic toner 11 | B | 89% | C | 83% | C | 8% | C |
| Comparative Example 1 | Magnetic toner 12 | C | 82% | D | 79% | B | 3% | A |
| Comparative Example 2 | Magnetic toner 13 | C | 80% | D | 75% | B | 5% | C |
| Comparative Example 3 | Magnetic toner 14 | C | 82% | D | 72% | D | 10% | D |
| Comparative Example 4 | Magnetic toner 15 | D | 78% | D | 77% | A | 1% | B |
| Comparative Example 5 | Magnetic toner 16 | D | 75% | D | 67% | C | 8% | D |
| Comparative Example 6 | Magnetic toner 17 | C | 80% | D | 70% | D | 10% | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-158911, filed on Jul. 31, 2013, which is hereby incorporated by reference herein in its entirety.

The invention claimed is:

1. A magnetic toner, comprising:

a magnetic toner particle comprising a binder resin and a magnetic material;

a first external additive; and a second external additive, wherein:

the first external additive i) comprises an organic-inorganic composite fine particle, a plurality of convexes derived from an inorganic fine particle being present on a surface of the organic-inorganic composite fine particle, and ii) has a number-average particle diameter of 50 nm or more and 500 nm or less;

the second external additive i) comprises a silica fine particle, and ii) has a number-average particle diameter of 5 nm or more and 30 nm or less;

a shear load calculated from a rotation torque is 0.50 kPa or more and 2.00 kPa or less when a disc-shaped disc is pressed against a surface of a magnetic toner powder layer, the magnetic toner powder layer being produced by applying a vertical load of 9.0 kPa to the magnetic toner, under a vertical load of 5.0 kPa in a measurement container, and the disc which is being pressed is rotated by $\pi/36$ rad at $(\pi/10$ rad)/min; and an absolute value $|\zeta(T)-\zeta(A1)|$ of a difference between a zeta potential $\zeta(T)$ of the magnetic toner particle dispersed in water and a zeta potential $\zeta(A1)$ of the first external additive dispersed in water is 50 mV or less.

2. A magnetic toner according to claim 1, wherein the organic-inorganic composite fine particle comprising a resin particle, and an inorganic fine particle embedded to the resin particle.

3. A magnetic toner according to claim 1, wherein the first external additive is added in a ratio of 0.5 part by mass or more and 3.5 parts by mass or less with respect to 100 parts by mass of the magnetic toner particle, and a total coverage rate of the first external additive and the second external additive on a surface of the magnetic toner is 40% or more and 85% or less.

4. A magnetic toner according to claim 1, wherein a surface existence ratio of the inorganic fine particle in the organic-inorganic composite fine particle is 20% or more and 70% or less.

* * * * *